US008453309B2

(12) United States Patent
Vizjak et al.

(10) Patent No.: US 8,453,309 B2
(45) Date of Patent: Jun. 4, 2013

(54) METHOD FOR CHANGING A BELT IN A MACHINE ASSEMBLY USING A GRIPPER HAVING MOVEABLE OPPOSED LEGS

(75) Inventors: Thomas Vizjak, München (DE); Hans Winter, München (DE)

(73) Assignee: Océ Printing Systems GmbH, Poing (DE)

( * ) Notice: Subject to any disclaimer, the term of this patent is extended or adjusted under 35 U.S.C. 154(b) by 685 days.

(21) Appl. No.: 12/516,268

(22) PCT Filed: Nov. 15, 2007

(86) PCT No.: PCT/EP2007/062396

§ 371 (c)(1),
(2), (4) Date: Dec. 14, 2009

(87) PCT Pub. No.: WO2008/071512

PCT Pub. Date: Jun. 19, 2008

(65) Prior Publication Data

US 2010/0095503 A1 Apr. 22, 2010

(30) Foreign Application Priority Data

Dec. 12, 2006 (DE) ..... 10 2006 058 548

(51) Int. Cl.
*G03G 15/00* (2006.01)
*G03G 21/00* (2006.01)

(52) U.S. Cl.
CPC ..... *G03G 15/00* (2013.01); *G03G 21/00* (2013.01)
USPC ..... 29/402.08; 29/235; 294/99.1

(58) Field of Classification Search
USPC ..... 29/426.1, 426.5, 426.6, 402.03, 402.08, 29/402.09, 235, 239, 268; 294/99.1; 299/110, 299/116, 119, 221; 399/110, 116, 119, 221
See application file for complete search history.

(56) References Cited

U.S. PATENT DOCUMENTS

| | | | | | |
|---|---|---|---|---|---|
| 579,601 | A | * | 3/1897 | Neuenschwander | 269/2 |
| 2,585,421 | A | * | 2/1952 | Armand | 116/240 |
| 3,629,905 | A | * | 12/1971 | Cote | 24/30.5 R |
| 3,867,170 | A | * | 2/1975 | Ferguson et al. | 430/117.3 |
| 3,924,631 | A | * | 12/1975 | Mancusi, Jr. | 600/30 |

(Continued)

FOREIGN PATENT DOCUMENTS

| | | |
|---|---|---|
| DE | 912080 | 10/1953 |
| DE | GM 75 10 525 | 9/1975 |

(Continued)

*Primary Examiner* — David Bryant
*Assistant Examiner* — Jason L Vaughan
(74) *Attorney, Agent, or Firm* — Schiff Hardin LLP

(57) ABSTRACT

In a device or method to change a belt in a machine assembly, a gripper is provided with two flat legs. The legs are held at one end and are free at the other ends. The legs are provided with a respective protective film on side surfaces facing towards one another to protect the belt. A first of the two legs facing towards the machine assembly in an exchange of the belt have a sliding film on its outer surface. The legs are designed such that they exert a gripping force over a width of the belt after sliding onto the belt and grip the belt so that the belt can be slid onto or removed from rollers of at least one of the roller types selected from the group consisting of a drive roller and a deflection roller provided in the machine assembly.

9 Claims, 5 Drawing Sheets

U.S. PATENT DOCUMENTS

| | | | | |
|---|---|---|---|---|
| 4,258,493 | A * | 3/1981 | Kettlestrings et al. | 40/600 |
| 4,828,706 | A * | 5/1989 | Eddleman | 210/644 |
| 4,960,521 | A * | 10/1990 | Keller | 210/644 |
| 5,400,121 | A * | 3/1995 | Foote | 399/116 |
| 5,417,322 | A * | 5/1995 | Jeran et al. | 206/303 |
| 5,425,160 | A * | 6/1995 | Krapf | 24/67 R |
| 5,429,401 | A * | 7/1995 | Youmans | 294/1.4 |
| 5,682,653 | A * | 11/1997 | Berglof et al. | 24/303 |
| 5,708,924 | A * | 1/1998 | Shogren et al. | 399/116 |
| 5,978,625 | A | 11/1999 | Park | |
| 6,014,535 | A * | 1/2000 | Zenk et al. | 399/116 |
| 6,049,682 | A * | 4/2000 | Goetzke et al. | 399/116 |
| 6,052,548 | A * | 4/2000 | Yamamoto | 399/116 |
| 6,097,912 | A * | 8/2000 | Watson et al. | 399/116 |
| 6,178,300 | B1 * | 1/2001 | Lee et al. | 399/90 |
| 6,185,395 | B1 * | 2/2001 | Lee | 399/116 |
| 6,233,415 | B1 * | 5/2001 | Pang | 399/116 |
| 6,236,823 | B1 * | 5/2001 | Lee | 399/116 |
| 6,246,856 | B1 | 6/2001 | Kopp et al. | |
| 6,304,737 | B1 * | 10/2001 | Dotschkal | 399/117 |
| 6,356,725 | B1 * | 3/2002 | Park et al. | 399/116 |
| 6,363,600 | B2 * | 4/2002 | Pang | 29/426.5 |
| 6,459,871 | B2 * | 10/2002 | Kwak et al. | 399/116 |
| 6,623,196 | B1 * | 9/2003 | Lee et al. | 400/629 |
| 6,640,068 | B2 * | 10/2003 | Wagner et al. | 399/116 |
| 6,704,999 | B2 * | 3/2004 | Karaki et al. | 29/714 |
| 6,763,212 | B1 * | 7/2004 | Lee | 399/162 |
| 6,792,231 | B2 | 9/2004 | Maier et al. | |
| 6,923,119 | B1 * | 8/2005 | Frank | 101/232 |
| 6,970,669 | B2 * | 11/2005 | Mishra et al. | 399/116 |
| 7,065,839 | B2 * | 6/2006 | Just | 24/67 R |
| 7,066,494 | B1 * | 6/2006 | Di Prinzio | 281/42 |
| 7,373,697 | B2 * | 5/2008 | Moyer et al. | 24/303 |
| 2001/0052175 | A1 * | 12/2001 | Pang | 29/426.1 |
| 2002/0006292 | A1 * | 1/2002 | Kwak et al. | 399/116 |
| 2002/0117029 | A1 | 8/2002 | Lin | |
| 2003/0091367 | A1 * | 5/2003 | Wagner et al. | 399/116 |
| 2005/0111878 | A1 * | 5/2005 | Mishra et al. | 399/116 |

FOREIGN PATENT DOCUMENTS

| | | |
|---|---|---|
| DE | 102 04 640 | 12/2003 |
| DE | 20 2005 020 114 U1 | 4/2006 |
| EP | 0 892 313 | 1/1999 |
| GB | 343862 | 2/1931 |
| WO | WO 98/39691 | 9/1998 |

* cited by examiner

METHOD FOR CHANGING A BELT IN A MACHINE ASSEMBLY USING A GRIPPER HAVING MOVEABLE OPPOSED LEGS

BACKGROUND

Belts, in particular thin, continuous belts, are employed in the most varied use cases. For example, thin plastic belts are used for image development, image transfer and to transport toner in modern electrophotographic printers (WO 98/39691). The belts run in corresponding machine assemblies (for example electrophotography or transfer belt units) that, among other things, are constructed from: a belt drive and belt run regulator unit; deflection rollers that are borne such that they can rotate and/or stationary deflection bars; and a tensioning device.

The belts are subjected to a wear that makes an exchange necessary. It should be possible for an operator without special expertise to conduct the exchange. Expenditure and risk of damage to the belt should thereby be as low as possible. Likewise, the possibility must be present to remove the belts from the machine assemblies for maintenance purposes and to reinsert them (likewise without the risk of damage).

Different solution approaches for the insertion and removal of the belts from electrophotographic printers have been described previously.

One solution is to transport the belts in shaping packages (contour packaging). This contour packaging is placed at the machine assembly in which the belt is to be changed, and the belt can then be slid from the packaging into the machine assembly (for example U.S. Pat. Nos. 6,049,682, 5,400,121).

Moreover, solutions are applied in which the operator must thread the new belt into the machine with great care after a slight de-tensioning of the belt in the machine assembly. However, this is only possible with belts of short length.

An additional device for placement of the belt into a machine assembly is known from DE 102 04 640 B4. The operator thereby slides tubes on which the belt is borne into recesses provided in the machine assembly, whereby the contour of the belt it is fixed corresponding to its contour in the machine assembly. Upon shifting the belt, the belt glides over a cover hood arranged to the side of the machine assembly and from there onto the rollers or deflection rods of the machine assembly. In order to remove a belt arranged in a machine assembly from the machine assembly, the belt is drawn onto the tube arranged in the recesses, wherein the belt slides onto the tube and then the tube with the belt can be withdrawn.

This method leads to difficulties when a belt that exhibits poor sliding properties should be mounted on the machine assembly, for example when the belt possesses an inner surface made from a rubber-like material.

SUMMARY

It is an object to specify a device of simple design with which an insertion of a belt (in particular of a longer belt) into a machine assembly by the operator is possible without there existing a risk of damaging the belt, and without special expertise being required. The device should thereby also be usable for belts with poorly sliding inner surfaces.

In a device or method to change a belt in a machine assembly, a gripper is provided with two flat legs. The legs are held at one end and are free at the other ends. The legs are provided with a respective protective film on side surfaces facing towards one another to protect the belt. A first of the two legs facing towards the machine assembly in an exchange of the belt have a sliding film on its outer surface. The legs are designed such that they exert a gripping force over a width of the belt after sliding onto the belt and grip the belt so that the belt can be slid onto or removed from rollers of at least one of the roller types selected from the group consisting of a drive roller and a deflection roller provided in the machine assembly.

DESCRIPTION OF THE PREFERRED EMBODIMENTS

Figure 1:
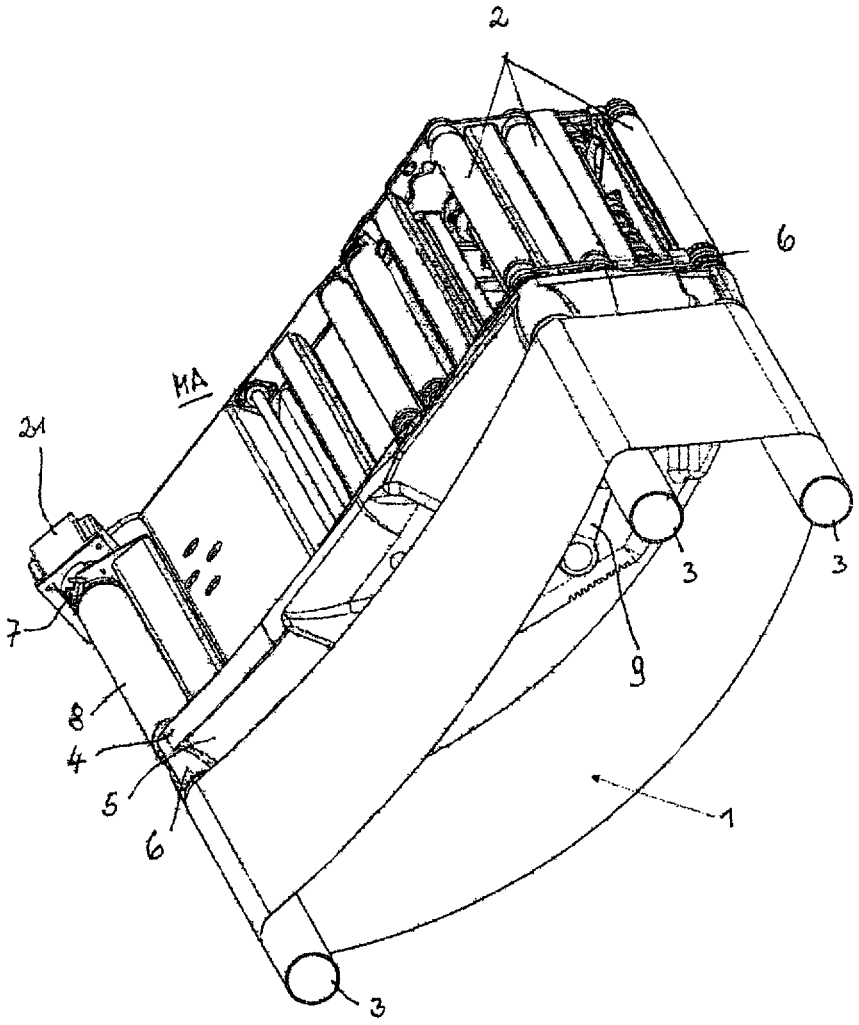
FIG. 1 is an overview image of a machine assembly, for example a transport device for a transfer belt of a transfer station corresponding to WO 98/39691 A1.

For the purposes of promoting an understanding of the principles of the invention, reference will now be made to the preferred embodiments/best mode illustrated in the drawings and specific language will be used to describe the same. It will nevertheless be understood that no limitation of the scope of the invention is thereby intended, and such alterations and further modifications in the illustrated device and method, and such further applications of the principles of the invention as illustrated as would normally occur to one skilled in the art to which the invention relates are included.

Advantages of the device of the preferred embodiment are apparent in the following:

- A defined grip force is exerted over an entire width of the belt so that the danger of damage to the belt (for example buckling) is substantially avoided upon changing a belt.
- It is not necessary to engage in the machine assembly during the exchange.

The device of the preferred embodiment is particularly suitable for changing belts in an electrographic printing or copying device, for example to change a photoconductor belt or a transfer belt that frequently has sliding properties and exhibits a very sensitive surface that may not be kinked, for example.

In order to achieve the required tension force, the one leg of the gripper arrangement can have metal parts and at least one magnet can be arranged on the other leg, which magnet then exerts an attraction force on the one leg. Furthermore, the gripper arrangement can have a grip (for example a handle) at one end of the leg, in which handle the legs are fixed. The gripper arrangement then stands under a pre-tension that can be canceled by an operator before gripping the belt and becomes effective again after the sliding onto the belt so that the gripper arrangement automatically clamps the belt.

In order to facilitate the sliding of the belt onto the drive and/or deflection roller (also commonly called rollers in the following), sliding films can be arranged on the inside of the belt, at least at the regions that are slid onto rollers. The sliding films can be attached to the belt such that they can be removed again after the insertion of the belt.

Furthermore, protective films can be arranged on the inner surfaces of the legs of the gripper arrangement that face towards one another so that the gripper arrangement does not damage the belt upon engagement. If a sliding film is arranged on the outer surface of the lower leg of the gripper arrangement, upon insertion of the belt over one of the rollers this sliding film can be placed at the insertion point of the gripper arrangement and therefore facilitates the insertion of the belt.

Removable sliding films can also additionally be arranged around the rollers.

In order to bring the belt exactly into its operating position (desired position), an adjustment device can be provided that drives the belt into its desired position upon feeding the belt into the machine assembly.

Upon changing the belt, an operator fixes the belt between the legs of the gripper arrangements, slides the belt with the gripper arrangement onto the deflection and/or drive rollers arranged in the machine assembly (MA) until it is in the desired position. He subsequently relaxes the gripper arrangement so that the legs of the gripper arrangement release the belt and the gripper arrangement can be pulled out of the machine assembly.

The insertion procedure is furthermore facilitated in that the belt is placed on at least two tubes that are slid into recesses arranged in the machine assembly such that the belt adopts the contour that it has in the machine assembly. The belt can then be inserted directly into the machine assembly via the gripper arrangement and can be tensioned by a tensioning mechanism after the insertion. It is advantageous when the operator places sliding films around the drive and/or deflection rollers before the insertion of the belt in order to improve the sliding of the belt over the rollers. These sliding films can be removed again after the insertion of the belt. For this the belt can be moved via the gripper arrangement until the sliding films are uncovered. The gripper arrangement can subsequently be removed from the machine assembly again together with the sliding films.

The insertion of a belt into the machine assembly can occur in the following steps:

- the tubes with the belt are initially placed into the recesses in the machine assembly,
- sliding films are then slid onto the rollers, for example via the tubes,
- the belt is grasped with the gripper arrangement and is slid from this onto the rollers until it is in the desired position,
- the belt is moved in the feed direction by the gripper arrangement until the sliding films are uncovered,
- the gripper arrangement and the sliding films are subsequently pulled from the machine assembly,
- the belt is finally tensioned.

In order to remove a belt arranged in a machine assembly from the machine assembly again, an operator can execute the following steps:

- after relaxing the belt, sliding films are slid under the belt,
- the gripper arrangement is slid over the belt,
- the belt is moved in the feed direction via the gripper arrangement until the sliding films are situated between the rollers and the belt,
- the tubes are placed into the recesses,
- the belt is pulled out of the machine assembly on the tubes with the gripper arrangement and the sliding films.

The solution according to the preferred embodiment differs from known insertion devices in its simplicity. A very secure device for the sensitive plastic belts is provided in a cost-effective and environmentally friendly manner (for example reuse of a space-saving packaging). An additional advantage of the solution is that the preferred embodiment can be used similarly for machine assemblies with different contours.

The possibility also exists that, for example, belts that are extracted from one printer and should be reused can be placed in a packaging by the operator without damage in a reverse order of the insertion process.

The preferred embodiment is explained further using an exemplary embodiment that is shown in drawing figures.

FIG. 1 shows a machine assembly MA that, for example, can be the transport device for an intermediate carrier belt in an electrophotographic printing or copying apparatus (WO 98/39691). In the explanation, only the parts of the machine assembly MA that play a role in the insertion of the belt 1 are mentioned. The parts of the machine assembly MA are of typical design and can be learned from the patent documents cited above.

The machine assembly MA has rollers 2, 8 via which the belt 1 is directed. These rollers drive the belt 1 in part (roller 8) or serve only for deflection of the belt 1 (roller 2). In order to be able to slide the belt 1 onto the rollers 2, 8, the belt should beforehand adopt a contour that, for example, is defined by the position of the rollers 2, 8. For this the belt 1 is borne on tubes (for example three tubes). For example, the belt can be arranged in a package (not shown) and be extracted from this situated on the tubes 3.

The machine assembly MA is provided with a cover hood 4 on the side from which the belt 1 should be slid. This can be provided with a conical shape and smooth at the edges 5 over which the belt should slide. The cover hood 4 additionally possesses recesses 6 into which the tubes 3 can be slid. The recesses 6 can also be arranged in the machine assembly MA itself. a1

For further details of the machine assembly MA, refer to DE 102 04 640 B4, which is incorporated into the disclosure.

The insertion process of the belt 1 is explained in the following.

FIG. 1 shows the beginning of the insertion. The belt 1 (which has been extracted from a package, for example) is borne on the tubes 3 and should be inserted into the machine assembly MA. The belt 1 is borne on three tubes 3, for example, that are shown in principle. The tubes 3 are inserted into the recesses 6. In the example of FIG. 1 the recesses 6 are arranged in the cover hood 4. By plugging the tubes 3 into the recesses 6, the belt 1 is preshaped so that the contour of the belt 1 that is demanded by the machine assembly MA already exists in approximation.

In the next step, the belt 1 is slid over the cover hood 4, wherein the belt 1 assumes the contour of the machine assembly MA. Upon further insertion into the machine assembly MA, the belt slides onto the rollers 2, 8 of the machine assembly MA.

The belt 1 has finally reached its desired position. The belt 1 is tensioned with the aid of a clamping lever 9. The tubes 3 can subsequently be withdrawn. A sensor 7 (for example a photoelectric barrier) that scans the edge of the belt 1 is provided to establish the desired position of the belt 1 in the inserted state. In the exemplary embodiment of FIG. 1, the roller 8 is used as a drive roller, for example, that is driven by a motor 21. By changing the position of the drive roller 8 (for example by tilting), the belt 1 can be adjusted so that it exactly assumes its desired position.

Figure 2:
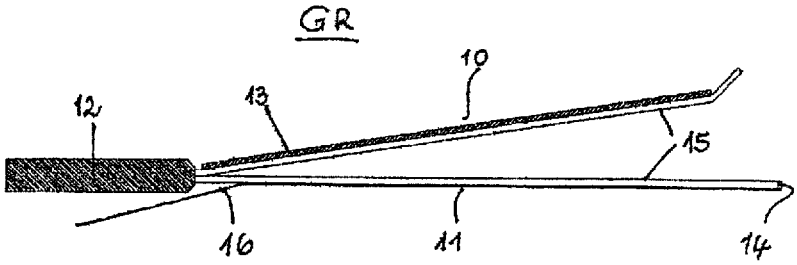
FIG. 2 is a gripper arrangement viewed from the side.

Upon sliding the belt 1 onto the machine assembly MA, it is to be taken into account that this is difficult to access in the printer (not shown in FIG. 1), and that the belt 1 is flexible, may not be damaged and additionally slides poorly on the rollers 2, 8. For this reason the preferred embodiment provides a gripper arrangement GR (FIG. 2). This has two legs 10 and 11 standing under tension that, in FIG. 2, are fixed at one end in a handle 12 and in contrast to this are freely movable at the other end. A magnet 13 is arranged at the one leg 10 (for example the upper leg), which magnet 13 exerts a defined attraction force on the other leg 11 (for example the lower leg over its entire width. For this the lower leg 11 has a metal part 14. The inner surfaces of the legs 10 and 11 are provided with a protective film 15 in order to protect the belt 1 from damage when the legs 10 and 11 encompass the legs 10 and 11. The outer surface of the lower leg 11 can additionally possess a sliding film 16.

If the gripper arrangement GR should grasp the belt 1, an operator can lift the upper leg 10 at the free end, then slide the legs 10, 11 around the belt 1. The upper leg 10 rests on the belt 1 with the protective film 15 and, due to the magnetic force, the gripper arrangement GR grasps the belt 1. The operator can now slide the belt 1 onto the rollers 2, 8 with the gripper arrangement GR.

In order to facilitate the insertion process, a sliding film 16, 17 can be placed around the rollers 2, 8 that drive or deflect the belt 1 before the belt 1 is slid on. A sliding film 17 is shown in principle in FIG. 3. It encompasses the drive roller 8. The sliding film 16 arranged on the lower leg 11 of the gripper arrangement GR can be used as an additional sliding film that is placed around the deflection roller 2.

Figure 3:
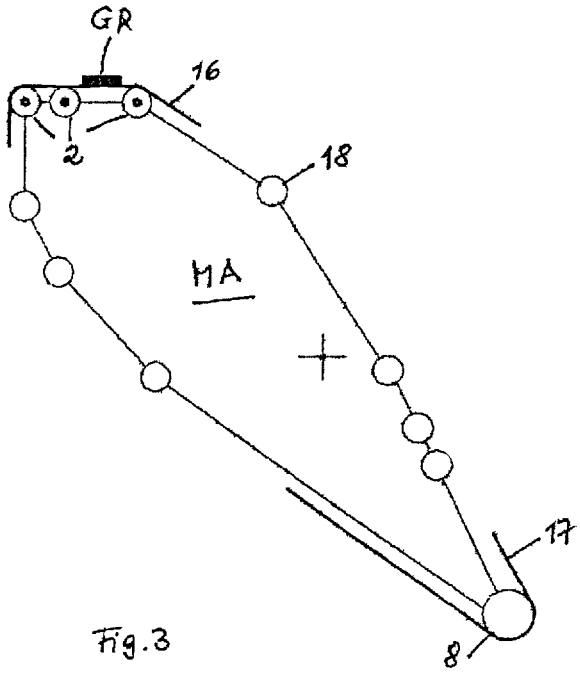
FIG. 3 is a side view of the machine assembly in principle representation without inserted belt, in which sliding films are placed around the rollers.

Only the contour of the machine assembly MA without belt 1 is shown in FIG. 3, with the deflection rollers 2 and the drive roller 8 and a belt tensioning roller 18 whose position can be varied by the belt clamping lever 9. Furthermore, the gripper arrangement GR with the sliding film 16 is indicated.

Figure 4:
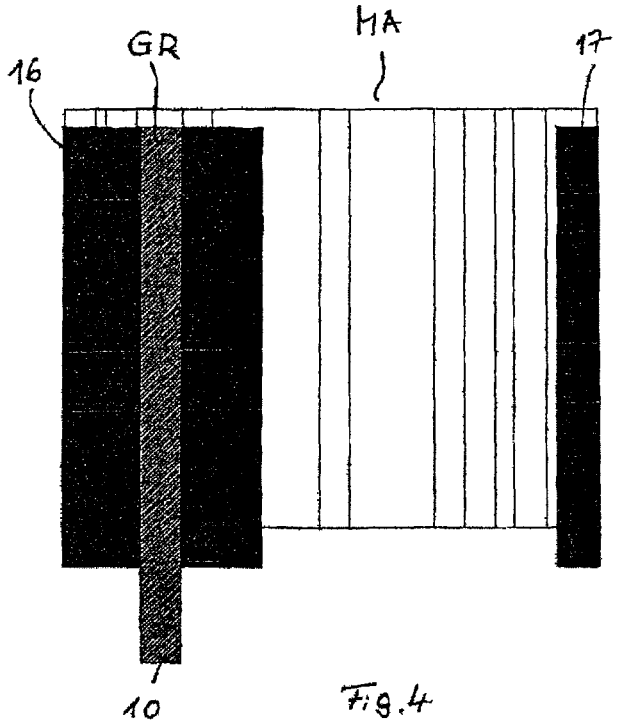
FIG. 4 is a plan view of the representation according to FIG. 3.

A plan view of the arrangement of FIG. 3 results from FIG. 4. The sliding films 16, 17 over the rollers 2, 8 and the gripper arrangement GR is shown. In the gripper arrangement GR, the extent of the leg 10 and the sliding surface 16 arranged on the lower leg 11 are recognizable, via which sliding surface 16 a safe grasping of the belt 1 is possible without damage to the belt 1. The extent of the gripper arrangement GR and the sliding surface 16 can be adapted to the respective application case.

Figure 5:
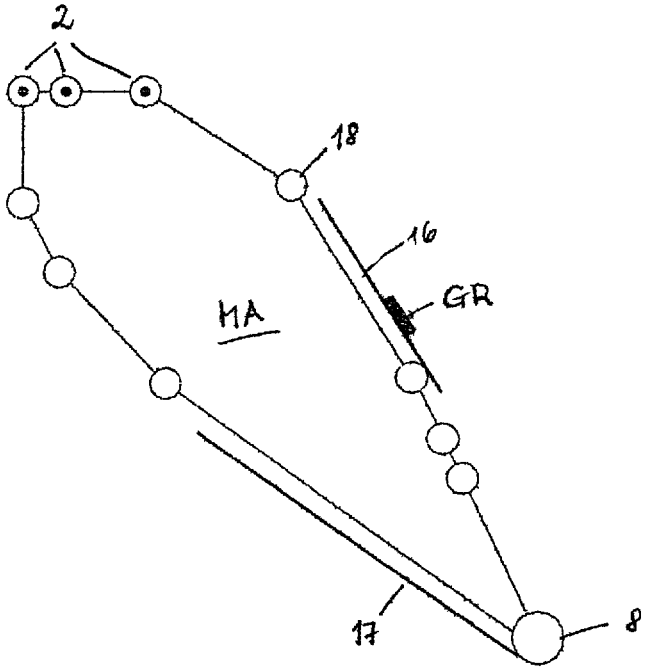
FIG. 5 is a side view of the machine assembly in principle representation, in which the sliding films have been moved away from the rollers.

If the sliding film 17 has been attached on the roller 8, the gripper arrangement GR can slide the belt 1 (not shown in FIG. 4), wherein the sliding surface 16 of the gripper arrangement GR slides over the rollers 2. The belt 1 can subsequently be moved in its feed direction with the gripper arrangement GR until the sliding films 16, 17 under the belt 1 are uncovered and can be removed (FIG. 5).

Only one sliding film 16, 17 is shown in FIG. 3; depending on the design of the machine assembly MA and the arrangement of the rollers, more than one sliding film 17 can also be used.

Figure 6:
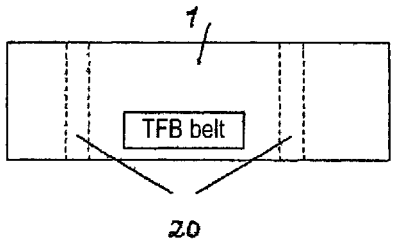
FIG. 6 is a plan view of a belt in which sliding films are arranged on its inner side.
Figure 7:
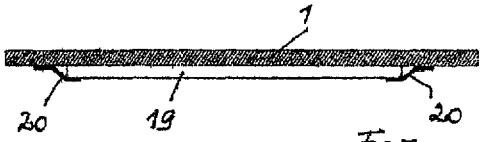
FIGS. 7 and 8 show side views of a belt with attached sliding films.
Figure 8:
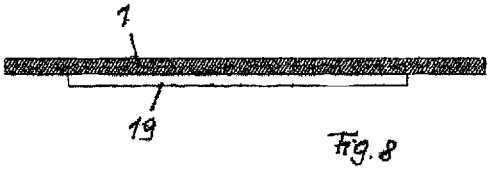

In order to facilitate the sliding of the belt 1 onto the roller 2, in a further exemplary embodiment a sliding film 19 can be arranged on the underside of the belt 1, for example it can be adhered with an adhesive tape 20 (FIGS. 6 and 7) that can be removed laterally so that the sliding film 19 can be released from the belt 1. Naturally, the sliding film 19 can also be adhered to the belt 1 (FIG. 8). The use of the sliding film 17 is then be not absolutely necessary.

With the gripper arrangement GR, the belt 1 can be slid onto the rollers 2, 8 of the machine assembly MA until the sensor arrangement indicates that the belt 1 is in the desired position. If the exact desired position cannot be achieved with the gripper arrangement GR, the drive roller 8 can be moved slowly and the position of the drive roller 8 can be adjusted so that the belt 1 runs into the desired position.

The insertion of the belt 1 into the machine assembly MA with the device according to the preferred embodiment can take place in the following steps:

- The belt 1 is slid onto the tube 3, and this is placed into the recesses 6, wherein the belt 1 assumes approximately the contour of the machine assembly MA.
- The sliding film 17 is slid onto the roller 8 (for example over the tube 3); this step is omitted if a sliding film 19 is adhered to the belt 1.
- The gripper arrangement GR is slid onto the belt 1; for this the upper leg 10 is lifted, then the belt 1 is placed on the lower leg 11 and the upper leg 10 is released so that this rests on the belt 1 due to magnetic force and grasps the 1.
- The belt 1 is slid with the gripper arrangement GR onto the rollers 2, 8 (for example via the tube 3) until this has reached a desired position.
- The belt 1 is moved in the feed direction with the gripper arrangement GR until the sliding films 16, 17 are freely accessible.
- The gripper arrangement GR and the sliding films 16, 17 are withdrawn from the machine assembly MA. If sliding film 19 adhered below the belt 1 is used instead of the sliding film 17, this sliding film 19 is removed unless it is permanently adhered.
- If necessary, the slow feed is activated and the belt 1 is brought into the exact desired position via the adjustment of the drive roller 8.

The extraction of the belt 1 can take place with the following steps:

- The sliding films 16, 17 (possibly 19) are slid below the belt 1, wherein the sliding films lie in front of the rollers 2, 8.
- The gripper arrangement GR is slid onto the belt 1, for example before a deflection roller 2.
- The belt 1 is moved with the gripper arrangement GR in the feed direction until the sliding films 16, 17 come to lie between the rollers 2, 8 and the belt 1.
- The tubes 3 are placed into the recesses 6.
- The belt 1 (and thereby also the sliding films 16, 17) is extracted from the machine assembly MA with the gripper arrangement GR.

The preferred embodiment is suitable for the insertion and exchange of very thin and very long belts that can additionally exhibit poor sliding properties. The invention is thereby usable for machine assemblies of different geometry (and therefore different contour). The device is additionally very simple to manipulate.

Although preferred exemplary embodiments have been shown and described in detail in the drawings and in the preceding specification, these should be viewed as purely exemplary and not as limiting the invention. It is noted that only the preferred exemplary embodiments are shown and described, and all variations and modifications that presently and in the future lie within the protective scope of the invention should be protected.

We claim as our invention:

1. A method for changing a belt in a machine assembly that is an electrographic printing or copying apparatus, said belt having an outer surface and an inner surface, comprising the steps of:

providing a gripper with two flat longitudinally extending oppositely opposed strip-like legs;

wherein the legs are joined at one end of each leg;

wherein the legs are not joined at the end of each leg opposite of the joined end;

wherein each leg includes a protective film on a surface of the leg that faces the other leg;

wherein the legs are moveable from an open position to a closed clamping position;

sliding the gripper over the belt and then moving the legs of the gripper into the closed clamping position such that the legs exert a gripping force onto the outer and inner surfaces of the belt over a width of the belt;

while gripping the belt at said outer and inner surfaces between the legs of the gripper in said closed clamping position, using the gripper to slide the belt onto rollers of the machine assembly;

wherein the rollers are of at least one of the roller types selected from the group consisting of a drive roller and a deflection roller arranged at the machine assembly; and moving the legs of the gripper to the open position such that the legs of the gripper release the belt, and then withdrawing the gripper from the machine assembly.

2. The method according to claim 1 wherein the belt is tensioned, after being slid onto the rollers, via a tensioning roller actuated by a clamping lever.

3. The method according to claim 1 wherein sliding films are placed around the rollers before of the belt is slid onto the rollers in order to aid the sliding of the belt on the rollers.

4. The method according to claim 3 wherein the sliding films are removed after of the belt is slid onto the rollers.

5. The method according to claim 4 wherein before the sliding films are removed, the belt is moved in a feed direction until the sliding films are uncovered.

6. The method according to claim 3 wherein: before the belt is slid onto the rollers, tubes are placed into recesses in the machine assembly;

after the belt is slid onto the rollers, moving the belt utilizing the gripper in a feed direction until a portion of the sliding films are uncovered; and after the belt has been moved withdrawing the sliding films from the machine assembly.

7. The method according to claim 6 wherein after the gripper and sliding films have been withdrawn, a belt feed device is activated in order to bring the belt into a desired position in the machine assembly.

8. The method according to claim 6 wherein said belt comprises a plastic belt for at least one of image development, image transfer, or to transport toner in said electrographic printing or copying apparatus.

9. The method of claim 1 wherein a first of the two legs includes a sliding film on an outer surface of the leg.

* * * * *